US006493951B1

(12) United States Patent
Smith et al.

(10) Patent No.: US 6,493,951 B1
(45) Date of Patent: Dec. 17, 2002

(54) ADJUSTABLE SIGHT FOR ARCHERY BOW

(75) Inventors: Allan F. Smith, Tucson, AZ (US); Terry L. Hart, Tucson, AZ (US); David H. Kronengold, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 09/963,916

(22) Filed: Sep. 26, 2001

(51) Int. Cl.[7] ..... F41G 1/033; F41G 1/467
(52) U.S. Cl. ..... 33/265; 124/87
(58) Field of Search ..... 33/265; 124/87

(56) References Cited

U.S. PATENT DOCUMENTS 4,481,717 A * 11/1984 Kowalski ..... 33/265
4,514,907 A 5/1985 Saltzman ..... 33/265
5,425,177 A 6/1995 Pacenti ..... 33/265
5,694,698 A 12/1997 Slates ..... 33/265
6,216,681 B1 * 4/2001 Dougherty et al. ..... 124/88

* cited by examiner

*Primary Examiner*—Christopher W. Fulton
*Assistant Examiner*—Tania Courson
(74) *Attorney, Agent, or Firm*—Cahill, Sutton & Thomas P.L.C.

(57) ABSTRACT

Apparatus for adjusting the vertical placement of a bow sight on an archery bow is provided with a belt extending over a drive pulley and an idler pulley. A sight mount is secured to the belt for movement therewith between the pulleys and a sight is attached to the sight mount. A sight adjustor lock locks the sight in position by preventing rotation of the drive pulley.

12 Claims, 3 Drawing Sheets

ADJUSTABLE SIGHT FOR ARCHERY BOW

FIELD OF THE INVENTION

The present invention relates generally to adjustable sight assemblies for archery bows. More particularly, the present invention relates to adjustment control of an adjustable archery sight through the use of a driver pulley, an idler pulley, and a belt operatively engaging the pulleys. The sight is attached to the belt for movement therewith.

PRIOR ART

Archery bows and the use of adjustable sights therewith are well known in the art. Such adjustable archery sights vary from simple to complex assemblies each varying with respect to ease of use and cost.

One type of prior art archery sight control mechanism provides an adjustable sight with a rotatable sight adjustor shaft near the bow draw string. In one example of this type of archery sight control mechanism, a flexible shaft is coupled between a rotatable adjustor shaft and a lead screw for transmitting the rotational movement of the adjustor shaft to rotational movement of the lead screw. A sight mount, threadedly engages the lead screw and is vertically movable as the lead screw rotates. This type of mechanism tends to be imprecise and is difficult to properly adjust; further, such flexible shaft mechanisms fail to give a "smooth" feel to the adjustment that is desirable with modern compound bows and auxiliary equipment and is relatively expensive.

OBJECTS OF THE INVENTION

It is therefore an object of the invention to provide an inexpensive adjustable sight assembly for use on an archery bow.

It is another object of the invention to provide an inexpensive adjustable sight assembly for use on an archery bow that provides smooth and precise control over the vertical movement of the sight.

It is yet another object of the invention to provide a reliable and easily adjusted sight for use on an archery bow.

SUMMARY OF THE INVENTION

The present invention is an inexpensive adjustable sight assembly which provides firm and direct control over vertical movement of a bow sight. According to one embodiment of the invention, the rotation of a sight adjustor knob, mounted at one end of a rotatable adjustor rod is transmitted to a drive pulley mounted on an opposite end of the adjustor rod such that when the sight adjustor knob is rotated, the drive pulley correspondingly rotates. An idler pulley, spaced from the drive pulley, is provided and a belt is wrapped around both pulleys. Rotation of the drive pulley imparts linear motion to the belt as it travels vertically between the pulleys. A sight block is attached to that portion of the belt between the drive pulley and the idler pulley. Movement of the belt thus translates into vertical movement of the sight block between the drive pulley and the idler pulley. One embodiment of the invention also includes an adjustor rod lock to restrict movement of the drive pulley, thereby maintaining a predetermined position of the sight block.

BRIEF DESCRIPTION OF THE DRAWINGS

The nature of the present invention as well as other embodiments of the present invention may be more clearly understood by reference to the following detailed description of the invention, to the appended claims, and to the drawings herein, wherein:

DETAILED DESCRIPTION OF THE INVENTION

Figure 1:
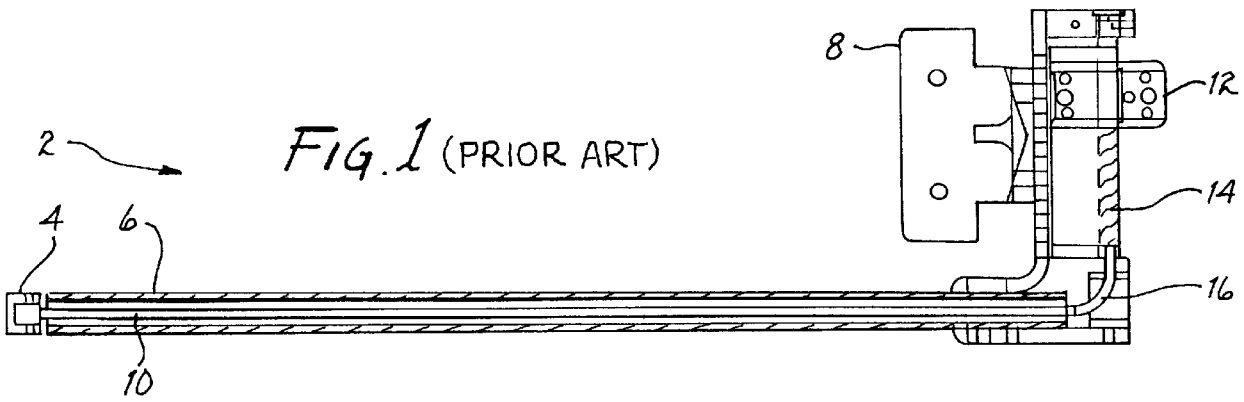
FIG. 1 (PRIOR ART)
FIG. 1 a side view, partly in section, of a prior art adjustable sight assembly.

One type of prior art archery sight assembly, a side view of which is shown in FIG. 1, involves an adjustable sight assembly 2 for mounting on an archery bow (not shown) which provides a user of the bow with a sight adjustor knob 4 near the bow draw string for rapid sight adjustment when the bow is raised into the shooting position. The adjustable sight assembly 2 includes a cable guard 6 and bow mount 8 found on conventional bows, but also includes a sight adjustor knob 4, an adjustor rod 10 extending through the center of the cable guard 6, a sight block 12 for mounting a sight pin, and a lead screw 14 to which the sight block 12 is threadedly engaged. To transmit the rotational movement of the sight adjustor knob 4 to vertical movement of the sight block 12, the sight assembly 2 further incorporates a flexible shaft 16 coupled between the adjustor rod 10 and a lead screw 14. When the adjustor knob 4 is rotated, the flexible shaft 16 similarly rotates, thus rotating the lead screw 14. As the lead screw 14 rotates, the sight block 12, which is threadedly coupled to the lead screw 14, slides up or down on the lead screw 14 in relation to the direction of rotation of the sight adjustor knob 4.

One difficulty experienced with the use of a flexible shaft 16 to translate rotational movement between the sight adjustor knob 4 and the sight block 12, is that the rotational movement does not always evenly transfer to the sight block 12. Because the flexible shaft 16 inherently includes a degree of elasticity, initial movement of the sight adjustor knob 4 does not move the sight block 12. The initial rotational movement of the sight adjustor knob 4 rotates one end of the flexible shaft 16 to build up enough rotational force within the flexible shaft 16 to overcome an initial static friction force between the lead screw 14 and the sight block 12. Furthermore, due to variances in the frictional force between the lead screw 14 and the sight block 12, the flexible shaft 16 may release rotational force to the lead screw 14 unevenly, thus, reducing control accuracy over the vertical movement of the sight block 12. In other words, use of the flexible shaft 16 to translate rotational movement from the sight adjustor knob 4 to the lead screw 14 is difficult to accurately control. Additionally, use of a lead screw 14 to adjust the vertical position of the sight is susceptible to dirt and other debris clogging up the threads of the lead screw 14 or the sight block 12, thus, further restricting movement of the sight block 12 and causing the transfer of rotational movement through the flexible shaft 16 to be even more uneven.

Figure 2:
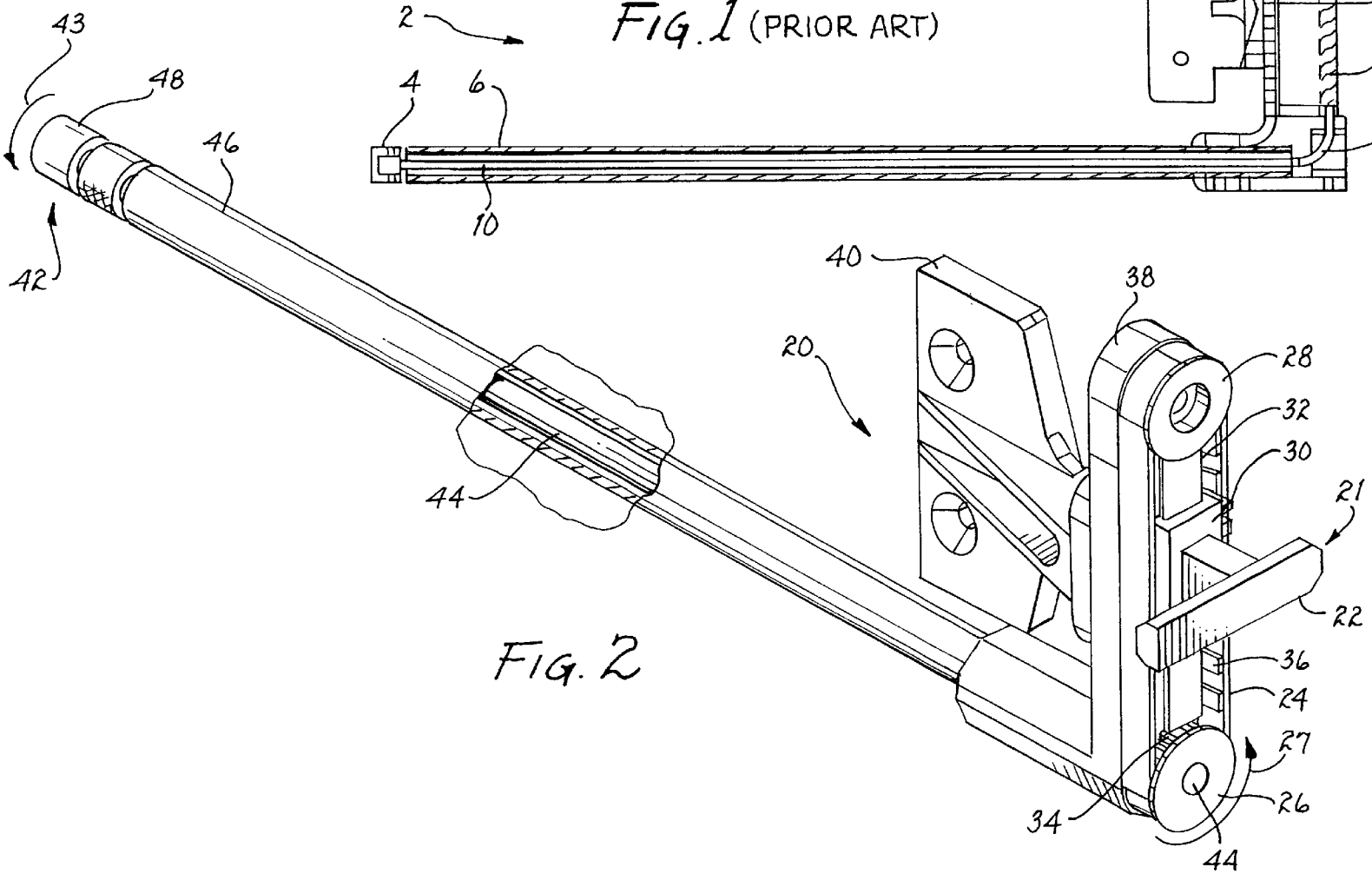
FIG. 2 is an isometric view, partly in section, an adjustable sight assembly constructed according to the teachings of the present invention.

Referring now to FIG. 2, an adjustable sight assembly 20 according to a first embodiment of the present invention is shown. In this embodiment of the invention, a sight 21, including a sight block 22, is attached to a side of a drive belt 24 between a drive pulley 26 and an idler pulley 28. As used herein, the term "belt" is intended to include belts having rectangular cross-sections such as those belts shown in the various embodiments, as well as belts having round, oval, square, or other shaped cross-sections, chains, cables, and any other drive transferring apparatus known in the art which frictionally or otherwise engages a drive pulley, thereby enabling transmission of rotational drive pulley movement to sight translational movement. Rotation of the drive pulley 26 causes the drive belt 24 to move around the drive pulley 26 and idler pulley 28, and the sight 21 to move between the drive pulley 26 and the idler pulley 28. Although the sight 21 may be directly mounted on the drive belt 24, in the embodiment chosen for illustration, the sight 22 is secured to a sight mount 30 which in turn is secured to the drive belt 24. The sight mount 30 slides along a sight mount track 32. In this manner, the sight movement is smooth and less responsive to bow movements or jolts.

In the embodiment shown in FIG. 2, an outer surface of the drive pulley 26 includes radially extending indentations 34, and the drive belt 24 includes corresponding teeth or protrusions 36 on its inside surface. By providing such corresponding indentations 34 and protrusions 36 on the pulley 26 and belt 24 respectively, the belt and pulley "mesh" with each other to thus prevent belt slippage. Such indentations may also be included on the idler pulley 28 if desired. It will be clear to one of ordinary skill in the art that in a much simpler embodiment of the present invention, a belt without protrusions and a belt support, such as a rod, may be used in place of the idler pulley 28 to support the upper portion of the drive belt 24 and provide tension in the drive belt 24. Similarly, it will be clear to one of ordinary skill in the art that the meshing indentations and protrusions 34 and 36 respectively, while desirable, may not be necessary to every embodiment of the present invention. The friction required to transfer rotational movement of the drive pulley 26 to the drive belt 24 may be established through sufficient tension in the drive belt 24, or alternatively by other forms of protrusions on either the drive pulley 26, the drive belt 24, or both.

The idler pulley 28 is rotationally mounted on a sight housing 38 to maintain an operable distance between the idler pulley 28 and the drive pulley 26. A mount 40 for mounting the. sight assembly to a bow is securely coupled to the sight housing 38. The bow mount 40 may be integrally formed with the sight housing 38, or may alternatively be formed as a separate piece and coupled to the housing 38 through adhesive, screws, welding, or any other method known in the art. The drive pulley 26 is coupled to the sight adjustor 42 through the adjustor rod 44 to permit rotation of the pulley 26 by rotating the sight adjustor and thus the adjustor rod 44.

As shown in FIG. 2, the adjustor rod 44 is formed with a knob 48 at one end thereof to permit convenient rotation of the rod 44 by an operator. Because the sight adjustor 42 is directly coupled to the drive pulley 26 by the adjustor rod 44, rotating the sight adjustor 42 as indicated by the arrow 43, correspondingly rotates the drive pulley 26 proportionally, as indicated by arrow 27, thereby providing direct control over the vertical position of the sight 21. Though not required, a protective covering may be placed around the drive belt 24, drive pulley 26 and idler pulley 28.

The drive belt 24 may be formed of rubber compounds, silicon, metal parts (i.e. chain), or other materials which may be formed to contact the surfaces of the drive pulley 26 and the idler pulley 28. The sight adjustor 42, sight 21, mount 40 and sight housing 38 may be formed of any rigid material, such as aluminum or other metal, or may be formed using available rigid plastic materials.

Figures 3, 4:
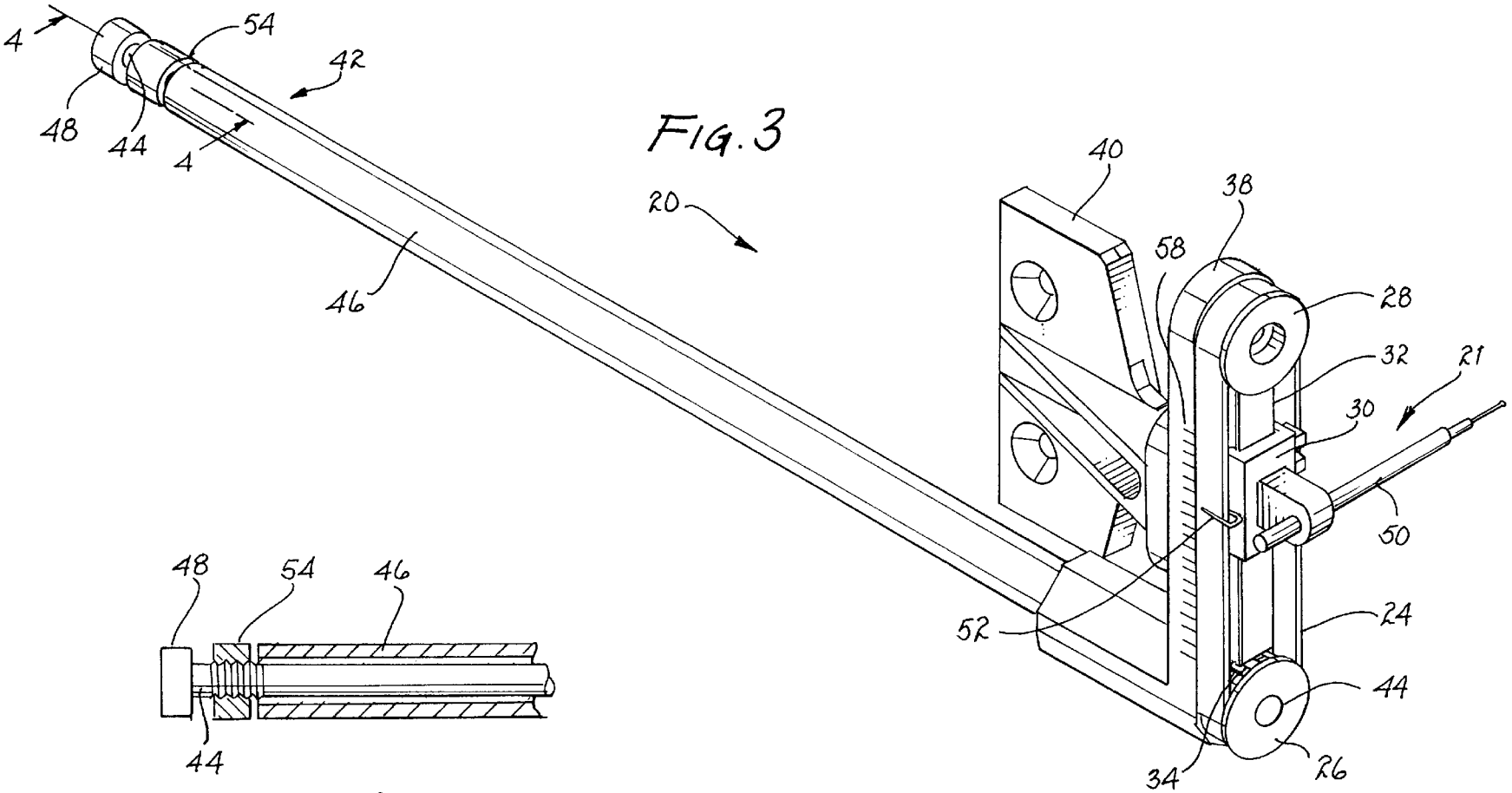
FIG. 3 is a isometric view of an alternate embodiment of adjustable sight assembly constructed in accordance with the teachings of the present invention.
FIG. 4 is a cross-sectional view of a portion of the adjustable sight assembly of FIG. 3, taken along line 4—4.

In another embodiment of the present invention, as shown in FIG. 3, the sight block 22 (shown in FIG. 2) is replaced by a sight pin 50. As will be clear to one of ordinary skill in the art, the sight pin 50 may be replaced by or formed into any of a number of sight tools including, but not limited to, cross-hairs, a scope, a laser sight, a fiber optic sight, and the like. Additionally, a distance indicator 52 is attached to the sight mount 30 and adjusts up and down with the sight pin 50. The position of the distance indicator 52 relative to a range scale 58 may be used to indicate a chosen distance an arrow will travel to hit the target when using the sight 21 in that position. In this way, an archer may select a range setting to impart an appropriate trajectory to an arrow to cause the arrow to strike a target at a given distance.

In the embodiments shown in FIGS. 2 and 3 a sight adjustor lock 54 for restricting the rotational movement of the drive pulley 26 is shown. The sight adjustor lock 54 restricts the rotational movement of the drive pulley 26 by directly contacting either the adjustor rod 44, or the sight adjustor knob 48. Alternatively, the sight adjustor lock 54 may be configured to restrict rotational movement of the drive pulley 26 by directly contacting the drive pulley 26.

Referring to FIG. 4, the sight adjustor lock 54 may take the form of a simple lock nut or jam nut that threadedly engages the adjuster rod 44 and may be manually tightened in abutment with cable guard 46 to thereby restrict the rotation of the adjustor rod. The sight adjustor knob 48 and the sight adjustor lock 54 also preferably include textured surfaces to better enable an archer to grip them securely for rotational movement. Other locking mechanisms for restricting rotational movement are well known in the art and may be substituted for the sight adjustor lock shown and described herein without departing from the invention.

Figure 5:
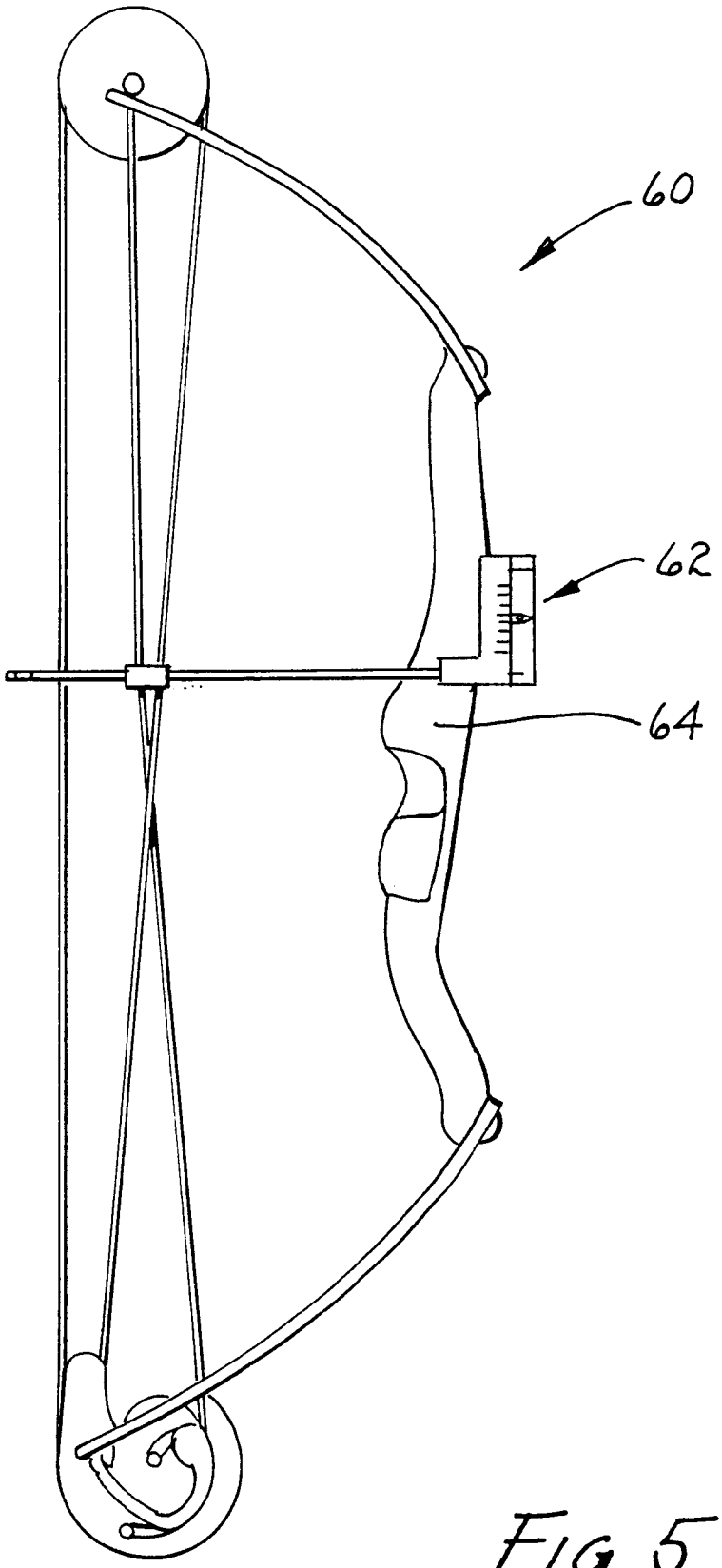
FIG. 5 is a diagram of a typical archery bow including a sight assembly according to an embodiment of the present invention.

FIG. 5 is a diagram of an archery bow 60 incorporating a sight assembly 62 constructed in accordance with the teachings of the present invention. It will be understood by one of ordinary skill in the art that the sight assembly may be secured to the bow through a mounting plate such as that shown in FIGS. 2 and 3 or may be formed using part of the bow riser 64 as an integral part of the sight assembly.

Although the present invention has been shown and described with reference to particular preferred embodiments, various additions, deletions and modifications that are obvious to a person skilled in the art to which the invention pertains, even if not shown or specifically described herein, are deemed to lie within the scope of the invention as encompassed by the following claims.

What is claimed is:

1. An adjustable sight for an archery bow comprising:

a drive pulley;

a belt support vertically spaced from said drive pulley;

a drive belt extending around said drive pulley and said belt support;

a sight adjustor coupled to said drive pulley for rotating said drive pulley and translating said drive belt; and, a sight coupled to the drive belt for movement therewith between the drive pulley and the belt support through rotational movement of the sight adjustor.

2. The bow sight assembly of claim 1, wherein the belt support is an idler pulley.

3. The bow sight assembly of claim 1, wherein said sight includes a sight mounting block slidably seated on a mount track extending between the drive pulley and the belt support.

4. The bow sight assembly of claim 3, wherein said sight further includes a sight pin coupled to the sight mounting block.

5. The bow sight assembly of claim 3, wherein said sight further includes a distance indicator coupled to the sight mounting block.

6. The bow sight assembly of claim 1, wherein said sight adjustor comprises an adjustor rod coupled to the drive pulley and extending therefrom.

7. The bow sight assembly of claim 6, wherein the adjustor rod extends through a hollow cable guard.

8. The bow sight assembly of claim 1, wherein said drive pulley includes indentations and said drive belt includes protrusions, and wherein said indentations and protrusions mesh to prevent slippage of said belt relative to the drive pulley.

9. An adjustable sight for an archery bow, said bow including a hollow cable guard:

a drive pulley;

an adjustor rod extending through said hollow cable guard having one end secured to said drive pulley for rotation therewith;

a belt support vertically spaced from said drive pulley;

a drive belt extending around said drive pulley and said belt support;

a sight adjustor knob secured to an opposite end of said adjustor rod to permit rotation of the knob, adjustor rod, and drive pulley;

a sight coupled to said drive belt for movement therewith between the drive pulley and the belt support through rotational movement of said drive pulley.

10. The combination set forth in claim 9 wherein said belt support is an idler pulley.

11. The combination set forth in claim 9 wherein said sight includes a sight mounting block slidably seated on a mount track extending between the drive pulley and the belt support.

12. The combination set forth in claim 9 wherein said sight includes a sight mounting block slidably seated on a mount track extending between the drive pulley and the belt support and wherein said sight further includes a distance indicator coupled to the sight mounting block.

* * * * *